US010730306B2

(12) United States Patent
Koide et al.

(10) Patent No.: US 10,730,306 B2
(45) Date of Patent: Aug. 4, 2020

(54) LIQUID DISCHARGE HEAD

(71) Applicant: Brother Kogyo Kabushiki Kaisha, Nagoya-shi, Aichi-ken (JP)

(72) Inventors: Shohei Koide, Nagoya (JP); Keita Sugiura, Toyokawa (JP); Hiroshi Katayama, Nagoya (JP); Jiro Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 35 days.

(21) Appl. No.: 16/217,709

(22) Filed: Dec. 12, 2018

(65) Prior Publication Data

US 2019/0299620 A1 Oct. 3, 2019

(30) Foreign Application Priority Data

Mar. 29, 2018 (JP) ..... 2018-064496

(51) Int. Cl.
*B41J 2/175* (2006.01)
*B41J 2/145* (2006.01)
*B41J 2/14* (2006.01)

(52) U.S. Cl.
CPC ..... *B41J 2/175* (2013.01); *B41J 2/145* (2013.01); *B41J 2/14233* (2013.01); *B41J 2002/14306* (2013.01); *B41J 2002/14419* (2013.01); *B41J 2002/14459* (2013.01); *B41J 2202/08* (2013.01); *B41J 2202/11* (2013.01); *B41J 2202/12* (2013.01)

(58) Field of Classification Search
CPC ..... B41J 2/175; B41J 2/14233; B41J 2/145; B41J 2202/08; B41J 2202/11; B41J 2002/14419; B41J 2202/12; B41J 2002/14306; B41J 2002/14459
See application file for complete search history.

(56) References Cited

U.S. PATENT DOCUMENTS

| | | | | |
|---|---|---|---|---|
| 7,971,981 | B2 | 7/2011 | Nagashima et al. | |
| 2008/0238980 | A1 | 10/2008 | Nagashima et al. | |
| 2009/0160887 | A1 | 6/2009 | Hamazaki et al. | |
| 2018/0281407 | A1* | 10/2018 | Hayashi | B41J 2/185 |
| 2019/0263115 | A1* | 8/2019 | Sugiura | B41J 2/14233 |

FOREIGN PATENT DOCUMENTS

| | | | |
|---|---|---|---|
| EP | 3459742 | A1 | 3/2019 |
| JP | 2008-254196 | A | 10/2008 |
| JP | 2009-208445 | A | 9/2009 |

OTHER PUBLICATIONS

Jun. 19, 2019—(EP) Extended Search Report—App 18211389.4.

* cited by examiner

*Primary Examiner* — Huan H Tran
(74) *Attorney, Agent, or Firm* — Banner & Witcoff, Ltd.

(57) ABSTRACT

There is provided a liquid discharge head which includes a plurality of individual channels, each individual channel including a nozzle and a pressure chamber, an actuator, a supply channel, and a return channel. For each individual channel of the plurality of individual channels, with respect to the nozzle, the return channel and the pressure chamber are disposed at one side in the array direction, and the supply channel is disposed at the other side in the array direction. An end portion of the pressure chamber at the one side in the array direction is positioned between the nozzle and an end portion of the return channel at the one side in the array direction. A center of the return channel in the array direction is positioned between the nozzle and the outlet port.

21 Claims, 8 Drawing Sheets

LIQUID DISCHARGE HEAD

CROSS REFERENCE TO RELATED APPLICATION

The present application claims priority from Japanese Patent Application No. 2018-064496, filed on Mar. 29, 2018, the disclosure of which is incorporated herein by reference in its entirety.

BACKGROUND

Field of the Invention

The present disclosure relates to a liquid discharge head which is equipped with a plurality of individual channels including nozzles and pressure chambers.

Description of the Related Art

A liquid discharge head equipped with a plurality of individual channels including nozzles and pressure chambers, has been known. In the above described liquid discharge head, two common supply channels are provided for the plurality of individual channels, and a liquid is supplied from the two common supply channels to each individual channel.

SUMMARY

In the above described liquid discharge head, from a viewpoint of allowing to escape a heat, of an actuator facing the pressure chamber, to an outside of the individual channel, one of the two common supply channels may be assigned to a supply channel which supplies the liquid from a storage chamber storing the liquid, to the plurality of individual channels, and the other common supply channel may be assigned to a return channel which returns the liquid from the plurality of individual channels to the storage chamber, such that the liquid can be circulated between the storage chamber and the plurality of individual channels. However, in the above described liquid discharge head, in each individual channel, an end portion which connects the common supply channel is positioned between a nozzle and a middle of each common supply channel in the array direction with respect to an array direction in which the two common supply channels are arranged. In other words, an outlet port of each individual channel is at a position closer to the nozzle than the middle of the common supply channel which is the return channel, in the array direction. Therefore, even when the liquid is circulated as described above, it is not possible to let the heat of the actuator to be escaped (relieved) efficiently, and the heat of the actuator may be accumulated inside the individual channel.

An object of the present disclosure is to provide a liquid discharge head in which it is possible to suppress a problem of the heat of the actuator accumulating inside the individual channel.

According to an aspect of the present disclosure, there is provided a liquid discharge head including: a plurality of individual channels, each individual channel including a nozzle and a pressure chamber communicating with the nozzle, an actuator which is facing the pressure chamber in a facing direction, a supply channel which communicates with a storage chamber that stores a liquid and an inlet port of the plurality of individual channels, and which is extended in a extending direction which is orthogonal to the facing direction, and a return channel which communicates with an outlet port of the plurality of individual channels and the storage chamber and returns the liquid from the plurality of individual channels to the storage chamber, and which is extended in the extending direction and which is arranged along with the supply channel in a array direction which is orthogonal to the extending direction and the facing direction, wherein for each individual channel of the plurality of individual channels, in the array direction, with respect to the nozzle, the return channel and the pressure chamber are arranged at one side in the array direction, and an end portion of the pressure chamber at the one side in the array direction is positioned between the nozzle and an end portion of the return channel at the one side in the array direction, and a middle (center) of the return channel in the array direction is positioned between the nozzle and the outlet port.

DETAILED DESCRIPTION OF THE EMBODIMENTS

First Embodiment

Figure 1:
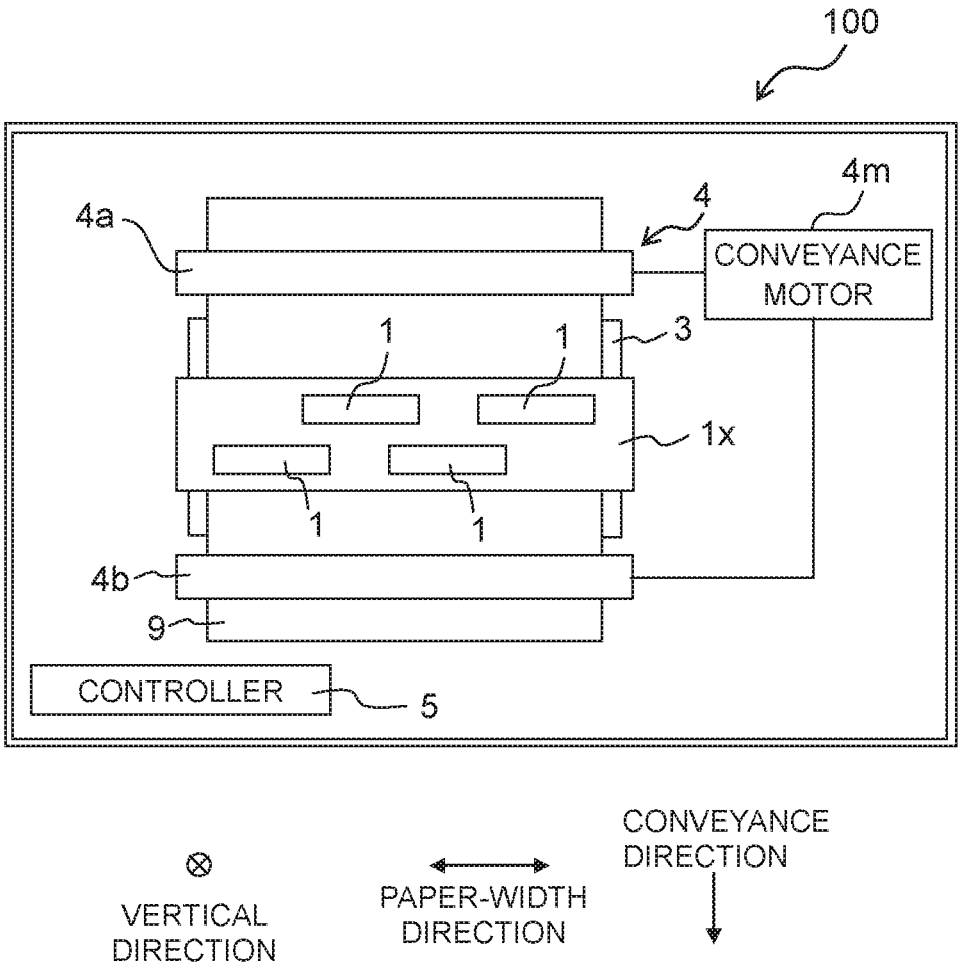
FIG. 1 is a plan view of a printer 100 which includes a head 1 according to a first embodiment.

An overall configuration (arrangement) of a printer 100 which includes a head 1 according to a first embodiment of the present disclosure will be described below.

The printer 100 includes a head unit 1*x* which includes four heads 1, a platen 3, a conveyance mechanism 4, and a controller 5.

A paper 9 is placed on an upper surface of the platen 3.

The conveyance mechanism 4 has two pairs of rollers 4*a* and 4*b* arranged to sandwich the platen 3 in a conveyance direction. As a conveyance motor 4*m* is driven by a control of the controller 5, the pair of rollers 4*a* and 4*b* rotate in a state of the paper 9 pinched, and the paper 9 is conveyed in the conveyance direction.

The head unit 1*x* is of a line type (a type in which an ink is jetted through a nozzle 21 in a state of a position fixed (refer to FIG. 2 and FIG. 3) on to the paper 9, and is long in a paper-width direction. The four heads 1 are arranged in a staggered from in the paper-width direction.

Here, the paper-width direction is orthogonal to the conveyance direction. Both the paper-width direction and the conveyance direction are orthogonal to a vertical direction.

The controller 5 includes a ROM (Read Only Memory), a RAM (Random Access Memory), and an ASIC (Application Specific Integrated Circuit). The ASIC executes a recording processing in accordance with a computer program stored in the ROM. In the recording processing, the controller 5 controls the conveyance motor 4*m* a driver IC 1*d* of each head 1 (refer to FIG. 3 and FIG. 4) on the basis of a recording command (including image data) input from an external equipment (device) such as a PC (personal computer), and records an image on the paper 9.

Next, an arrangement (a configuration) of the head 1 will be described below by referring to FIG. 2 and FIG. 3.

The head 1 includes a channel substrate 11 and an actuator unit 12.

Figure 3:
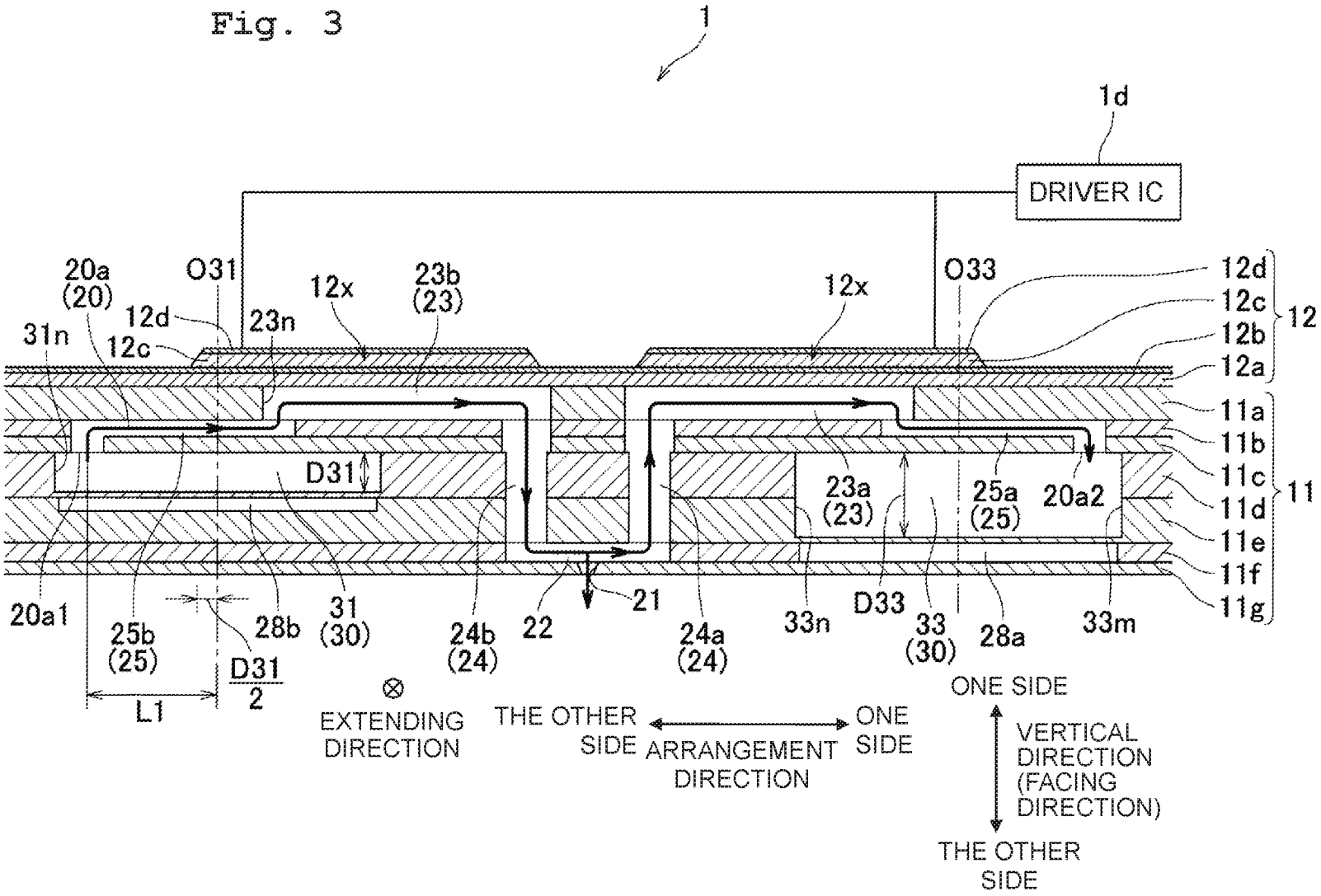
FIG. 3 is a cross-sectional view of the head 1 along a line in FIG. 2.
Figure 4:
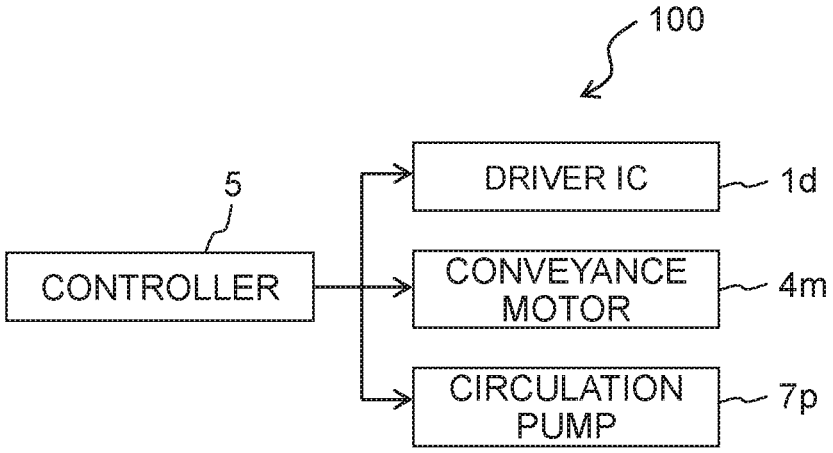
FIG. 4 is a block diagram showing an electrical configuration of the printer 100.

The channel substrate 11, as shown in FIG. 3, has seven plates 11*a*, 11*b*, 11*c*, 11*d*, 11*e*, 11*f*, and 11*g* (hereinafter, 'plates 11*a* to 11*f*') which are adhered to one another. A common channel 30 is formed in the plates 11*d* and 11*e*. A plurality of individual channels 20 communicating with the common channel 30 is formed in the plates 11*a* to 11*g*.

Figure 2:
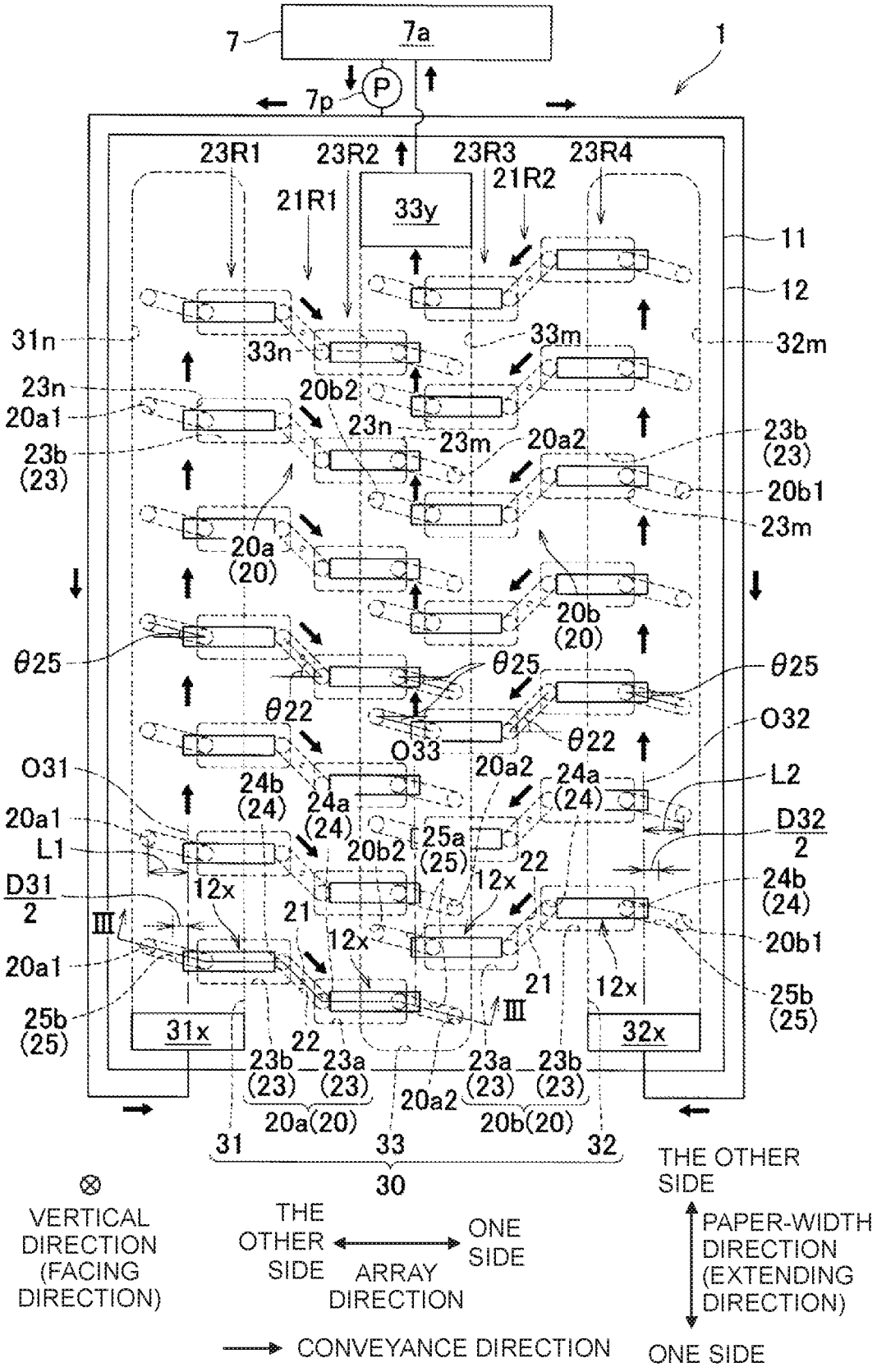
FIG. 2 is a plan view of the head 1.

The common channel 30, as shown in FIG. 2, includes supply channels 31 and 32, and a return channel 33 which are arranged in a array direction (a direction parallel to the conveyance direction). Each of the supply channels 31 and 32, and the return channel 33 is extended in a extending direction (a direction parallel to the paper-width direction). The return channel 33 is arranged between the supply channel 31 and the supply channel 32 in the array direction.

The supply channels 31 and 32 communicate with a storage chamber 7*a* of a sub tank 7 via supply ports 31*x* and 32*x* respectively. The return channel 33 communicates with the storage chamber 7*a* via a discharge port 33*y*. The supply ports 31*x* and 32*x* are formed at an end portion in one side of the extending direction (downward direction in FIG. 2) of the supply channels 31 and 32 respectively. The discharge port 33*y* is formed at an end portion in the other side of the extending direction of the return channel 33.

The sub tank 7 is mounted (installed) on the head 1. The storage chamber 7*a* communicates with a main tank (not shown in the diagram) which stores the ink, and stores the ink supplied from the main tank.

The individual channels 20 include a plurality of first individual channels 20*a* which connects the supply channel 31 and the return channel 33 and a plurality of second individual channels 20*b* which connects the supply channel 32 and the return channel 33. The first individual channel 20*a* is spread over or spread across the supply channel 31 and the return channel 33 in the array direction. The second individual channel 20*b* is spread over the supply channel 32 and the return channel 33 in the array direction. Each individual channel 20 is extended from an end portion of the individual channel 20 spaced apart from the nozzle 21, in the array direction of the supply channel 31 or the supply channel 32 up to an end portion of the individual channel 20 spaced apart from the nozzle 21 in the array direction of the return channel 33, passing transversely across one of the supply channel 31 and the supply channel 32, and the return channel 33 in the array direction.

Here, a length in the array direction of the supply ports 31*x* and 32*x* and the discharge port 33*y* is mutually same, and a length in the extending direction of each of the supply ports 31*x* and 32*y* is half a length in the extending direction of the discharge port 33*y*. In other words, an area of each of the supply ports 31*x* and 32*x* is half an area of the discharge port 33*y*. Such arrangement is made upon taking into consideration a fact that the number of individual channels 20 connected to each of the supply channels 31 and 32 is half the number of the individual channels connected to the return channel 33, and that an amount of ink that flows through each of the supply channels 31 and 32 is half an amount of ink that flows through the return channel 33.

Thick arrow marks in FIG. 2 and FIG. 3 show a flow of ink.

As shown in FIG. 2, the ink in the storage chamber 7*a* is supplied to the supply channels 31 and 32 through the supply ports 31*x* and 32*x* by two circulation pumps 7*p* being driven by a control of the controller 5. The ink supplied to the supply channel 31, while moving inside the supply channel 31 from one side of the extending direction (a downward direction in FIG. 2) to the other side of the extending direction (an upward direction in FIG. 2), is supplied to each of the plurality of first individual channels 20*a*. The ink supplied to the first individual channel 20*a* flows into the return channel 33. The ink supplied to the supply channel 32, while moving inside the supply channel 32 from the one side of the extending direction to the other side of the extending direction, is supplied to each of the plurality of second individual channels 20*b*. The ink supplied to the second individual channel 20*b* flows into the return channel 33. The ink flowed into the return channel 33 moves inside the return channel 33 from the one side of the extending direction to the other side of the extending direction. Moreover, the ink flowed into the return channel 33 is discharged from the return channel 33 through the discharge port 33*y* and returns to the storage chamber 7*a*. By circulating the ink between the storage chamber 7*a* and the plurality of individual channels 20, removal (elimination) of air bubbles inside the ink and prevention of thickening of ink are realized.

Each individual channel 20 includes a nozzle 21, a communicating channel 22, two pressure chambers 23, two connecting channels 24, and two joining channels 25. While the pressure chamber 23 is extended in the array direction, the communicating channel 22 and the joining channel 25 are extended in a direction inclined with respect to the array direction (a direction intersecting both the array direction and the extending direction). An angle θ25 on an acute angle side made by the two joining channels 25 of the second individual channel 20*b* with respect to the array direction is mutually same (nearly 5 degrees for example). An angle θ22 on an acute angle side made by the communicating channel 22 of the first individual channel 20*a* and the communicating channel 22 of the second individual channel 20*b* with respect to the array direction is mutually same (nearly 45 degrees for example).

As shown in FIG. 3, the nozzle 21 is a through hole formed in the plate 11*g*. The communicating channel 22 is a channel running directly above the nozzle 21, and is a through hole formed in the plate 11*e*. The pressure chamber 23 is a through hole formed in the plate 11*a*. The connecting channel 24 is a through hole formed in the plates 11*b* to 11*e*, and is extended in the vertical direction. The joining channel 25 is a through hole formed in the plates 11*b* and 11*c*.

The pressure chamber 23, the connecting channel 24, and the joining channel 25 are divided into (are classified as) a first pressure chamber 23*a*, a first connecting channel 24*b*, and a first joining channel 25*b*, and a second pressure chamber 23*b*, a second connecting channel 24*b*, and a second joining channel 25*b*. The first pressure chamber 23*a*, the first connecting channel 24*a*, and the first joining channel 25*b*, and the second pressure chamber 23*b*, the second connecting channel 24*b*, and the second joining channel 25*b* sandwich the nozzle 21 in the array direction. The first pressure chamber 23*a*, the first connecting channel 24*a*, and the first joining channel 25*a* are at positions between the nozzle 21 and the return channel 33 in the array direction or at positions overlapping with the return channel 33 in the vertical direction. The second pressure chamber 23*b*, the second connecting channel 24*b*, and the second joining channel 25*b* are at positions between the nozzle 21 and the supply channel 31 or the supply channel 32 in the array direction, or at positions overlapping with the supply channel 31 or the supply channel 32 in the vertical direction. The first joining channel 25*a* and a portion of the first pressure chamber 23*a* overlap with the return channel 33 in the vertical direction. The second joining channel 25*b* and a portion of the second pressure chamber 23*b* overlap with the supply channel 31 or the supply channel 32 in the vertical direction.

The first pressure chamber 23*a* communicates with the nozzle 21 via the first connecting channel 24*a* and the communicating channel 22. The second pressure chamber 23*b* communicates with the nozzle 21 via the second connecting channel 24*b* and the communicating channel 22. The first pressure chamber 23*a* and the second pressure chamber 23*b* communicate mutually via the communicating channel 22 and the second connecting channel 24*b*. The first connecting channel 24*a* connects one end of the pressure chamber 23*a*, nearer to the nozzle 21 in the array direction and one end of the communicating channel 22 nearer to the return channel 33 in the array direction. The second connecting channel 24*b* connects one end of the second pressure chamber 23*b* nearer to the nozzle 21 in the array direction and the other end in the array direction of the communicating channel 22. The first joining channel 25*a* joins the return channel 33 and the other end in the array direction of the first pressure chamber 23*a*. The second joining channel 25*b* joins the supply channel 31 or the supply channel 32 and the other end in the array direction of the second pressure chamber 23*b*.

The first individual channel 20*a* has an inlet port 20*a*1 connecting to the supply port 31 and an outlet port 20*a*2 connecting to the return channel 33. The inlet port 20*a*1 corresponds to an end portion of the second joining channel 25*b* of the first individual channel 20*a*, on a side opposite to the second pressure chamber 23*b*. The outlet port 20*a*2 corresponds to an end portion of the first joining channel 25*a* of the first individual channel 20*a*, on a side opposite to the first pressure chamber 23*a*.

The second individual channel 20*b* has an inlet port 20*b*1 connecting to the supply channel 32 and an outlet port 20*b*2 connecting to the return channel 33 (refer to FIG. 2). The inlet port 20*b*1 corresponds to the end portion of the second joining channel 25*b* of the second individual channel 20*b*, on a side opposite to the second pressure chamber 23*b*. The outlet port 20*b*2 corresponds to an end portion of the first joining channel 25*a* of the second individual channel 20*b*, on a side opposite to the first pressure chamber 23*a*.

The ink supplied to each individual channel 20 moves substantially horizontally running through the second joining channel 25*b* and the second pressure chamber 23*b* from the inlet ports 20*a*1 and 20*b*1, further moving downward through the second connecting channel 24*b*, and flows into the communicating channel 22. The ink flowed into the communicating channel 22 moves horizontally through the communicating channel 22, and after a part thereof being jetted through the nozzle 21, the remaining ink moves upward through the second connecting channel 24*b*, and moves substantially horizontally through the second pressure chamber 23*b* and the second joining channel 25*b*, and flows into the return channel 33 through the outlet ports 20*a*2 and 20*b*2.

The plurality of pressure chambers 23 open on an upper surface of the channel substrate 11 (an upper surface of the plate 11*a*) as shown in FIG. 2. The pressure chambers 23 form four pressure chamber rows 23R1, 23R2, 23R3, and 23R4 (hereinafter, referred to as 'pressure chamber rows 23R1 to 23R4'). The four pressure chamber rows 23R1 to 23R4 are extended in the extending direction and are arranged in the array direction. Out of the four pressure chamber rows 23R1 to 23R2, the two pressure chamber rows 23R1 and 23R2 on a left side in FIG. 2 are formed by first pressure chambers 23*a* and second pressure chambers 23*b* of the first individual channels 20*a*. Out of the four pressure chamber rows 23R1 to 23R4, the two pressure chamber rows 23R3 and 23R4 on a right side in FIG. 2 are formed by first pressure chambers 23*a* and second pressure chambers 23*b* of the second individual channels 20*b*. In each of the pressure chamber rows 23R1 to 23R4, the pressure chambers 23 are arranged at same positions in the array direction, and at a same interval in the extending direction. Whereas, between the pressure chamber rows 23R1 to 23R4, positions of the pressure chambers in the extending direction are shifted (misaligned). Accordingly, for all the pressure chambers 23, positions in the extending direction differ from positions of the pressure chambers 23 other than the abovementioned pressure chambers 23.

The plurality of nozzles 21 open on a lower surface of the channel substrate 11 (a lower surface of the plate 11*f*). The nozzles 21 form two nozzle rows 21R1 and 21R2 extended in the extending direction and arranged in the array direction. Out of the two nozzle rows 21R1 and 21R2, the nozzle row 21R1 on the left side in FIG. 2 is formed by the nozzles 21 of the first individual channels 20*a* and is sandwiched between the pressure chamber rows 23R1 and 23R2 in the array direction. Out of the two nozzle rows 21R1 and 21R2, the nozzle rows 21R2 on the right side in FIG. 2 is formed by the nozzles 21 of the second individual channels 20*b* and is sandwiched between the pressure chamber rows 23R3 and 23R4 in the array direction. In the nozzle rows 21R1 and 21R2, the nozzles 21 are arranged at same positions in the array direction and at an equal interval in the extending direction. Whereas, between the nozzle rows 21R1 and 21R2, the positions of the nozzles 21 in the extending direction are shifted (misaligned). Accordingly, for all the nozzles 21, positions in the extending direction differ from positions of the nozzles other than the abovementioned nozzles 21.

The actuator unit 12 is arranged on the upper surface of the channel substrate 11, and covers the plurality of pressure chambers 23.

The actuator unit 12, as shown in FIG. 3, includes in order from below, a vibration plate 12*a*, a common electrode 12*b*, a plurality of piezoelectric bodies 12*c*, and a plurality of individual electrodes 12*d*. The vibration plate 12*a* and the common electrode 12*b* are arranged on nearly the entire upper surface of the channel substrate 11, and cover the plurality of pressure chambers 23. Whereas, the piezoelectric bodies 12*c* and the individual electrodes 12*d* are provided to each pressure chamber 23 and are facing the respective pressure chambers 23.

In the common electrode 12*b*, the vibration plate 12*a*, and the plates 11*a* to 11*c*, through holes are formed at positions corresponding to the supply ports 31*x* and 32*x*, and the discharge port 33*y* (refer to FIG. 2). The supply ports 31*x* and 32*x*, and the discharge port 33*y* open on an upper surface of the head 1 and communicate with the supply channels 31 and 32, and the return channel 33 via the through holes.

The plurality of individual electrodes 12*d* and the common electrode 12*b* are electrically connected to the driver IC 1*d*. The driver IC 1*d* maintains an electric potential of the common electrode 12*b* to a ground electric potential and changes an electric potential of the individual electrode 12*d*.

More specifically, the driver IC 1*d* generates a drive signal on the basis of a control signal from the controller 5, and applies the drive signal generated to the individual electrode 12*d*. Accordingly, the electric potential of the individual electrode 12*d* varies between a predetermined drive electric potential and the ground electric potential. At this time, a volume of the pressure chamber 23 changes such that a portion of the vibration plate 12*a* and the piezoelectric body 12*c* sandwiched between the individual electrode 12*d* and the pressure chamber 23 (an actuator 12*x*) is deformed to form a projection toward the pressure chamber 23, and a pressure is applied to an ink in the pressure chamber 23, and the ink is jetted through the nozzle 21.

The actuator unit 12 has a plurality of actuators 12*x* facing the plurality of pressure chambers 23 respectively, in the vertical direction (facing direction). In the present embodiment, for each individual channel 20, it is possible to increase a velocity of flying of ink jetted from the nozzle 21 by driving simultaneously the actuators 12*x* facing the two pressure chambers 23.

In the present embodiment, as mentioned above, the supply channel 31 corresponds to the 'supply channel', the supply channel 32, corresponds to the 'another supply channel', and the return channel 33 corresponds to the 'return channel'. The first individual channel 20*a* corresponds to the 'individual channel' and the second individual channel 20*b* corresponds to the 'another individual channel'. In other words, the supply channel 31 is arranged with the return channel 33 in the array direction, sandwiching the nozzles 21 of the first individual channel 20*a*. The supply channel 32 is arranged with the return channel 33 in the array direction, sandwiching the nozzles 21 of the second individual channel 20*b*.

The nozzle 21 of the first individual channel 20*a* corresponds to the 'nozzle', the first pressure chamber 23*a* of the first individual channel 20*a* corresponds to the 'pressure chamber' and the 'first pressure chamber', and the second pressure chamber 23*b* of the first individual channel 20*a* corresponds to the 'second pressure chamber'. The actuator 12*x* facing the first pressure chamber 23*a* of the first individual channel 20*a* corresponds to the 'actuator' and the 'first actuator', and the actuator 12*x* facing the second pressure chamber 23*b* of the first individual channel 20*a* corresponds to the 'second actuator'. In other words, with respect to the nozzle 21 of the first individual channel 20*a*, the return channel 33 and the first pressure chamber 23*a* of the first individual channel 20*a* are arranged at the one side in the array direction, and the supply channel 31 and the second pressure chamber 23*b* of the first individual channel 20*a* are arranged at the other side in the array direction.

According to the present embodiment, for each first individual channel 20*a*, with respect to the array direction, an end portion 23*m* at the one side in the array direction of the first pressure chamber 23*a* is positioned between the nozzle 21 and an end portion 33*m* at the one side in the array direction of the return channel 33. Moreover, a middle (center) O33 in the array direction of the return channel 33 is positioned between the nozzle 21 and the outlet port 20*a*2 (refer to FIG. 2 and FIG. 3). In other words, the outlet port 20*a*2 of each first individual channel 20*a* is at a position spaced apart from the nozzle 21 than the center O33. Accordingly, it is possible to let the heat of the actuator 12*x* escape efficiently when the ink is circulated, and it is possible to suppress a problem of accumulation of heat of the actuator 12*x* inside the individual channel 20.

For each first individual channel 20*a*, the outlet port 20*a*2 is at a position not overlapping with the actuator 12*x* corresponding to the first pressure chamber 23*a*, in the facing direction (refer to FIG. 2 and FIG. 3). Since the actuator 12*x* generates heat by being driven, when the outlet port 20*a*2 is directly below the actuator 12*x*, the outlet port 20*a*2 has an effect of the heat of the actuator 12*x*, and the an effect of letting the heat escape by the circulation of ink is reduced (weakened). For instance, in a case in which there is ink inside the head 1, and the ink is not to be circulated between the storage chamber 7*a* and the plurality of individual channels 20, when all the actuators 12*x* of the head 1 are driven simultaneously, the actuators 12*x* may attain a temperature of about 50° C. In a case in which there is ink inside the head 1, and the ink is to be circulated between the storage chamber 7*a* and the plurality of individual channels 20, when all the actuators 12*x* of the head 1 are driven simultaneously, the actuators 12*x* may attain a temperature of about 30° C. With regard to this point, according to the present embodiment, the outlet port 20*a*2 being at the position not overlapping with the actuator 12*x* in the facing direction, it is possible to suppress more assuredly the problem of accumulation of heat of the actuator 12*x* inside the individual channel 20.

The return channel 33, in an upward direction (at an upper side) (one side in the facing direction which is a direction from the pressure chamber 23 directed toward the actuator 12*x*) is provided with the outlet port 20*a*2 of the first individual channel 20*a*, and in a downward direction (at a lower side) (the other facing direction), is provided with a damper chamber 28*a* (refer to FIG. 3). The damper chamber 28*a* is a through hole formed in the plate 11*f* and is in an area overlapping the entire return channel 33, in the facing direction. By a partition wall separating the return channel 33 and the damper chamber 28*a* being deformed, a fluctuation in a pressure of ink inside the return channel 33 is suppressed. In this arrangement, the outlet port 20*a*2 is at a position overlapping with the damper chamber 28*a* in the facing direction. Accordingly, a pressure wave that has entered the return channel 33 through the outlet portion 20*a*2 of the first individual channel 20 is directed assuredly toward the partition wall, and an effect of suppressing the pressure fluctuation by the deformation of the partition wall is exerted adequately.

The first joining channel 25*a* of the first individual channel 20*a* is extended in a direction orthogonal to the array direction (refer to FIG. 2). Accordingly, it is possible to make a width (length in the array direction) of the return channel 33 small while securing a length of the first joining channel 25*a*. Consequently, it is possible to make the head 1 small in the array direction.

The nozzle 21 of the second individual channel 20*b* corresponds to the 'another nozzle', the first pressure chamber 23*a* of the second individual channel 20*b* corresponds to the 'another first pressure chamber', and the second pressure chamber 23*b* of the second individual channel 20*b* corresponds to the 'another second pressure chamber'. The actuator 12*x* facing the first pressure chamber 23*a* of the second individual channel 20*b* corresponds to the 'another actuator' and the 'another first actuator', and the actuator 12*x* facing the second pressure chamber 23*b* of the second individual channel 20*b* corresponds to the 'another second actuator'. In other words, with respect to the nozzle 21 of the second individual channel 20*b*, the return channel 33 and the first pressure chamber 23*a* of the second individual channel 20*b* are arranged at the other side in the array direction, and the supply channel 32 and the second pressure chamber 20*b* of the second individual channel 20*b* are arranged at the one side in the array direction.

According to the present embodiment, the first individual channel 20*a* and the second individual channel 20*b* have the return channel 33 in common. In this case, it is possible to arrange the individual channels 20 with a density higher than that in a case in which one row of the individual channels 20 is provided for the return channel.

Moreover, for each second individual channel 20*b*, the other end 23*n* at the other side in the array direction of the first pressure chamber 23*a* is positioned between the nozzle 21 and the other end 33*n* at the other side in the array direction of the return channel 33, in the array direction. Moreover, the middle O33 in the array direction of the return channel 33 is positioned between the nozzle 21 and the outlet port 20*b*2 (refer to FIG. 2). In other words, the outlet port 20*b*2 of each second individual channel 20*b* is at a position spaced farther apart from the nozzle 21 than the middle O33. Accordingly, even in a case in which the individual channels 20 are arranged highly densely, it is possible to let the heat of the actuator 12*x* escape efficiently when the ink is circulated, and to suppress the problem of accumulation of heat of the actuator 12*x* inside the individual channel 20. In other words, it is possible to realize both of the highly dense arrangement of the individual channels 20 and the suppression of the problem of heat.

Each individual channel 20 includes two pressure chambers 23, and two actuators 12*x* are provided for each individual channel 20. In this case, the problem of the heat of the actuator 12*x* accumulating inside the individual channel 20 may become remarkable as compared to that in a case in which one actuator 12*x* was provided for each individual channel 20. According to the present embodiment, for each first individual channel 20*a*, an end portion 23*n* at the other side in the array direction of the second pressure chamber 23*b* is positioned between the nozzle 21 and an end portion 31*n* at the other side in the array direction of the supply channel 31, in the array direction. Moreover, the middle O31 in the array direction of the supply channel 31 is positioned between the nozzle 21 and the inlet port 20*a*1 (refer to FIG. 2). In other words, the inlet port 20*a*1 and the outlet port 20*a*2 of each first individual channel 20*a* is separated by a comparatively large distance in the array direction. Accordingly, even in the case in which two actuators 12*x* are provided, it is possible to let the heat of the actuator 12*x* escape efficiently when the ink is circulated and to suppress the problem of the heat of the actuator 12*x* accumulating inside the individual channel 20.

For each first individual channel 20*a*, the outlet port 20*a*2 is at a position not overlapping with the actuator 12*x* corresponding to the first pressure chamber 23*a* in the facing direction. Furthermore, for each first individual channel 20*a*, the inlet port 20*a*1 is at a position not overlapping with the actuator 12*x* corresponding to the second pressure chamber 23*b* in the facing direction (refer to FIG. 2 and FIG. 3). In such manner, by arranging both of the inlet port 20*a*1 and the outlet port 20*a*2 in each first individual channel 20*a* at the positions not overlapping with the actuator 12*x* in the facing direction, it is possible to suppress assuredly the problem of the heat of the actuator 12*x* accumulating inside the individual channel 20.

For each of the return channel 33 and the supply channel 31, the outlet port 20*a*2 and the inlet port 20*a*1 of the first individual channel 20*a* is provided at the upper side, and the damper chambers 28*a* and 28*b* are provided at the lower side (refer to FIG. 3). The damper chamber 28*b* is a recess formed in an upper surface of the plate 11*e*, and is in an area overlapping with nearly entire supply channel 31 in the facing direction. By a partition wall separating the supply channel 31 and the damper chamber 28*b* being deformed, it is possible to suppress a fluctuation in a pressure of ink inside the supply channel 31. In this arrangement, the outlet port 20*a*2 and the inlet port 20*a*1 of the first individual channel 20*a* are at positions overlapping with the damper chambers 28*a* and 28*b* respectively, in the facing direction. Accordingly, an effect of suppressing the pressure fluctuation in both the return channel 33 and the supply channel 31 is exerted adequately.

For each first individual channel 20*a*, in the array direction, a separating distance L1 between the inlet port 20*a*1 and the middle (center) O31 in the array direction of the supply channel 31 is not less than half a length D31 of the supply channel 31 in the facing direction (refer to FIG. 2 and FIG. 3). A flow velocity of the ink flowing in the extending direction through the supply channel 31 is the maximum in the middle O31 in the array direction of the supply channel 31, and is the minimum at the end portion in the array direction of the supply channel 31. Air bubbles entered into the supply channel 31 tend to gather near the middle O31 where the flow velocity is high. In this case, in the above-mentioned arrangement, by the inlet port 20*a*1 of the first individual channel 20*a* being positioned at an outer side of the air bubbles, it is possible to prevent the air bubbles from entering into the individual channel 20 from the supply channel 31.

Each of the first joining channel 25*a* and the second joining channel 25*b* of the first individual channel 20*a* is extended in a direction orthogonal to the array direction (refer to FIG. 2). Accordingly, even in an arrangement of connecting both the first joining channel 25*a* and the second joining channel 25*b* with respect to the return channel 33, it is possible to make a width of the return channel 33 small while securing a length of the first joining channel 25*a* and the second joining channel 25*b*. Consequently, it is possible to make the head 1 small in the array direction.

For each of the second individual channels 20*b*, with respect to the array direction, an end portion 23*m* at the one side in the array direction of the second pressure chamber 23*b* is positioned between the nozzle 21 and an end portion 32*m* at the one side in the array direction of the supply channel 32. Moreover, the middle O32 in the array direction of the supply channel 32 is positioned between the nozzle 21 and the inlet port 20*b*1 (refer to FIG. 2). In other words, the inlet port 20*b*1 and the outlet port 20*b*2 of the second individual channel 20*b* are separated by a comparatively longer distance in the array direction. Accordingly, even for the second individual channel 20*b*, similarly as for the first individual channel 20*a*, even in a case in which two actuators 12*x* are provided, it is possible to let the heat of the actuators 12*x* escape efficiently when the ink is circulated, and it is possible to suppress the problem of the heat of the actuator 12*x* accumulating inside the individual channel 20.

The first individual channel 20*a* and the second individual channel 20*b* have mutually same arrangement. Therefore, even in the second individual channel 20*b*, similarly as in the first individual channel 20*a*, the outlet port 20*b*2 is at a position not overlapping with the actuator 12*x* corresponding to the first pressure chamber 23*a* in the facing direction. Furthermore, the inlet port 20*b*1 is at a position not overlapping with the actuator 12*x* corresponding to the second pressure chamber 23*b* with respect to the facing direction (refer to FIG. 2). Moreover, with respect to the return channel 33 and the supply channel 32, the inlet port 20*b*1 and the outlet port 20*b*2 of the second individual channel 20*b* are provided at an upper side and the damper chambers 28*a* and 28*b* are provided at a lower side (refer to FIG. 3).

The outlet port 20*b*2 and the inlet port 20*b*1 of the second individual channel 20*b* are at positions overlapping with the damper chambers 28*a* and 28*b* respectively, in the facing direction. Moreover, for each of the second individual channel 20*b*, with respect to the array direction, a distance L2 separating the inlet port 20*b*1 and the middle O32 in the array direction of the supply channel 32 is not smaller than half a length D32 (=D31) in the facing direction of the supply channel 32 (refer to FIG. 2). Moreover, each of the first joining channel 25*a* and the second joining channel 25*b* of the second individual channel 20*b* is extended in a direction orthogonal to the array direction.

Each of an angle θ25 on an acute angle side of the first individual channel 20*a* with respect to the array direction of the first joining channel 25*a* and an angle θ25 on an acute angle side of the second individual channel 20*b* with respect to the array direction of the first joining channel 25*a* is smaller than an angle θ22 on an acute angle side of the first individual channel 20*a* with respect to the array direction of the communicating channel 22, and is smaller than an angle θ22 on an acute angle side of the second individual channel 20*b* with respect to the array direction of the communicating channel 22. When the angle θ25 of the first joining channel 25*a* of the first individual channel 20*a* is excessively large, the first joining channel 25*a* of the first individual channel 20*a* makes a contact with the first joining channel 25*a* and the first pressure chamber 23*a* of the second individual channel 20*b*. Similarly, when the angle θ25 of the first joining channel 25*a* of the second individual channel 20*b* is excessively large, the joining channel 25*a* of the second individual channel 20*b* makes a contact with the first joining channel 25*a* and the first pressure chamber 23*a* of the first individual channel 20*a*. Moreover, for each of individual channels 20*a* and 20*b*, when the angle θ22 of the communicating channel 22 is excessively small, the distance in the array direction separating the two pressure chambers 23 becomes long, and the head 1 becomes large in size in the array direction. However, according to the present embodiment, by the angle θ25 being made smaller than the angle θ22, it is possible to suppress both of a problem a contact between the components of the first individual channel 20*a* and the components of the second individual channel 20*b*, and a problem of the head 1 becoming large in size in the array direction.

The outlet port 20*a*2 of the first individual channel 20*a* and the outlet port 20*b*2 of the second individual channel 20*b* are arranged in a mutually staggered form in the extending direction (refer to FIG. 2). In the arrangement in which the first individual channel 20*a* and the second individual channel 20*b* have the return channel 33 in common, by arranging the outlet port 20*a*2 of the first individual channel 20*a* and the outlet port 20*b*2 of the second individual channel 20*b* in the staggered form, it is possible to realize efficiently the highly dense arrangement of the individual channels 20 and suppression of the problem of the heat of the actuator 12*x* accumulating inside the individual channel 20.

The outlet port 20*a*2 of the first individual channel 20*a* is at a position overlapping in the facing direction, with the actuator 12*x* facing the first pressure chamber 23*a* of the second individual channel 20*b*. The outlet port 20*b*2 of the second individual channel 20*b* is at a position overlapping in the facing direction, with the actuator 12*x* facing the first pressure chamber 23*a* of the first individual channel 20*a* (refer to FIG. 2). In this case, the heat of the actuator 12*x* is shared between the first individual channel 20*a* and the second individual channel 20*b*, and it is possible to suppress a difference in temperature of the ink that flows through the interior. Consequently, it is possible to suppress a variation in a velocity of jetting of ink jetted through the nozzle 21 of the first individual channel 20*a* and ink jetted through the nozzle 21 of the second individual channel 20*b*.

A width (length in the array direction) of each of the supply channels 31 and 32, and the return channel 33 is mutually same but the length D31 and the length D32 in the facing direction of the supply channels 31 and 32 respectively are smaller than a length D33 in the facing direction of the return channel 33 (refer to FIG. 3). For instance, the length D31 and the length D32 are nearly half the length D33 (the length D31 and the length D32 are 200 μm and the length D33 is 400 μm). Therefore, each of the supply channels 31 and 32 has a cross-sectional area smaller than a cross-sectional area of the return channel 33 and a channel resistance higher than a channel resistance of the return channel 33. Such arrangement is made upon taking into consideration a fact that the number of individual channels 20 connected to each of the supply channels 31 and 32 is half the number of the individual channels 20 connected to the return channel 33, and an amount of ink flowing through each of the supply channels 31 and 32 is half an amount of ink flowing through the return channel 33. According to this arrangement, it is possible to suppress a variation in a flow rate of the ink flowing through the three common channels 30 (the supply channels 31 and 32, and the return channel 33).

Moreover, for adjusting the channel resistance, by changing the size of the cross-sectional area of the channel, it is possible to suppress a variation in the flow rate of ink comparatively easily.

Furthermore, in a case of changing the size of the cross-sectional area of the channel, the length in the facing direction is to be changed (D31, D32<D33). Accordingly, an area orthogonal to the facing direction of the channel is suppressed from becoming small, and also the size of a partition wall separating the channel and the damper chamber which is provided below the channel is suppressed from becoming small. Therefore, it is possible to suppress the variation in the flow rate of ink while securing the effect of suppressing the pressure fluctuation due to the deformation of the partition wall.

The communicating channel 22 of each individual channel 29 is extended in a direction orthogonal to the array direction (refer to FIG. 2). Accordingly, it is possible to make the head 1 small in size in the array direction.

The head 1 is of a line type. In a serial type, there is a downtime between one scanning operation and the subsequent scanning operation, and heat may be radiated during this time. However, in a line type, there is no downtime, and heat of the actuator 12*x* is susceptible to be accumulated inside the individual channel 20. With regard to this point, in the present embodiment, by devising an idea for the positions of the outlet ports 20*a*2 and 20*b*2 connected to the return channel 22 in the individual channel 20, since it is possible to suppress the problem of the heat of the actuator 12*x* accumulating inside the individual channel, the above-mentioned arrangement is particularly effective.

Second Embodiment

Figure 5:
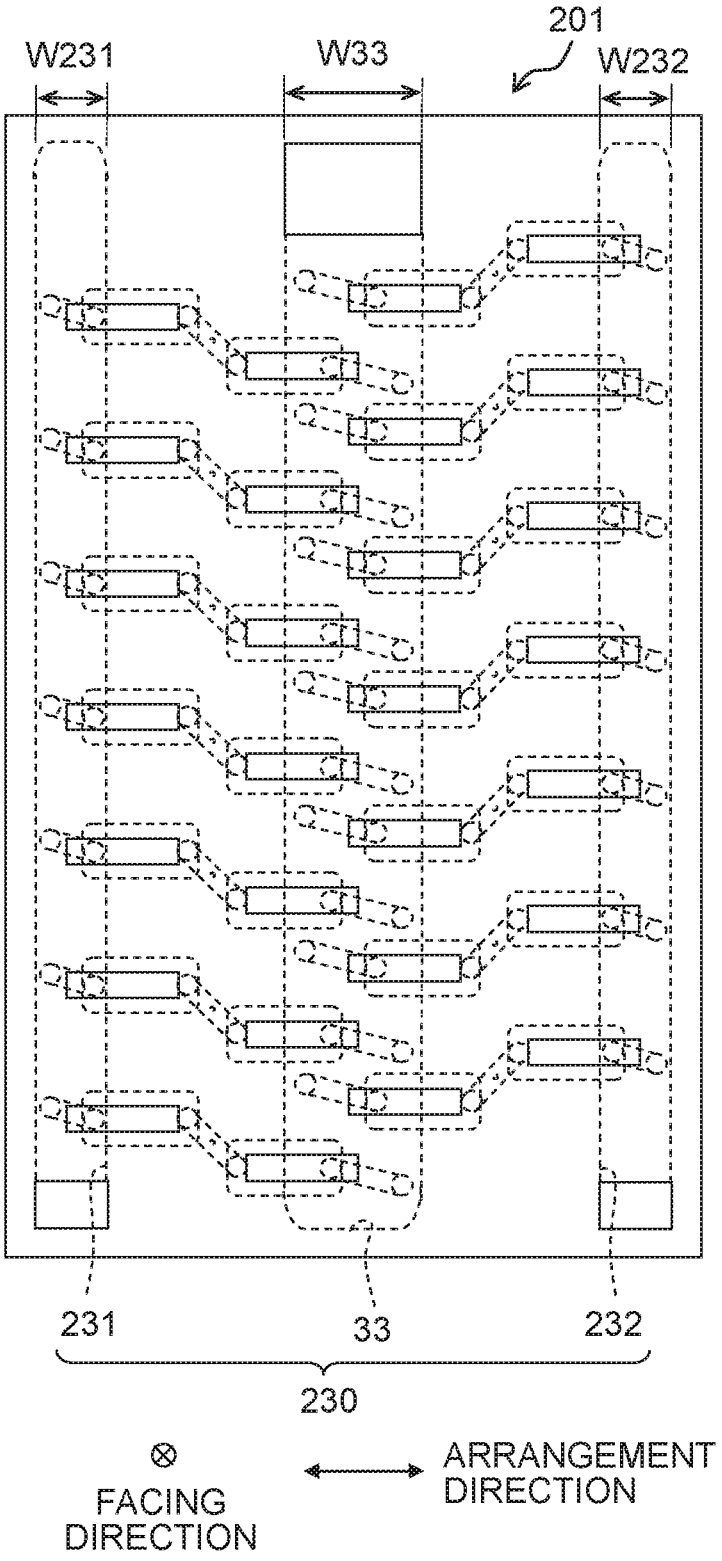
FIG. 5 is a plan view of a head 201 according to a second embodiment.

Next, a head 201 according to a second embodiment of the present disclosure will be described below by referring to FIG. 5. In the present embodiment, an arrangement of supply channels 231 and 232 differs from the arrangement of supply channels 31 and 32 in the first embodiment. The arrangement of the return channel 33 is same as in the first embodiment.

In the present embodiment, a length in the facing direction of each of the supply channels 231 and 232, and the length in the facing direction of the return channel 33 are mutually same, and widths (lengths in the array direction) W231 and W232 of the supply channels 231 and 232 respectively are smaller than a width W33 of the return channel 33. For instance, the widths W231 and W232 are nearly half the width W33 (the widths W231 and W232 may be 0.75 mm and the width W33 may be 1.5 mm). Therefore, each of the supply channels 231 and 232 has a cross-sectional area smaller than the cross-sectional area of the return channel 33, and a channel resistance higher than the channel resistance of the return channel 33.

According to the present embodiment, it is possible to suppress a variation in a flow rate of ink flowing through three common channels 230 (the supply channels 231 and 232, and the return channel 33).

Moreover, in a case of changing the size of the cross-sectional area of the channel, the width is to be adjusted (W231 and W232<W33). Accordingly, it is possible to make the head 201 small in size in the array direction.

Moreover, according to the present embodiment, although the arrangement of the supply channels 231 and 232 differs from the arrangement of the supply channels 31 and 32 in the first embodiment, the rest of the arrangement being similar to that in the first embodiment, an effect similar to that of the first embodiment is achieved.

Third Embodiment

Figure 6:
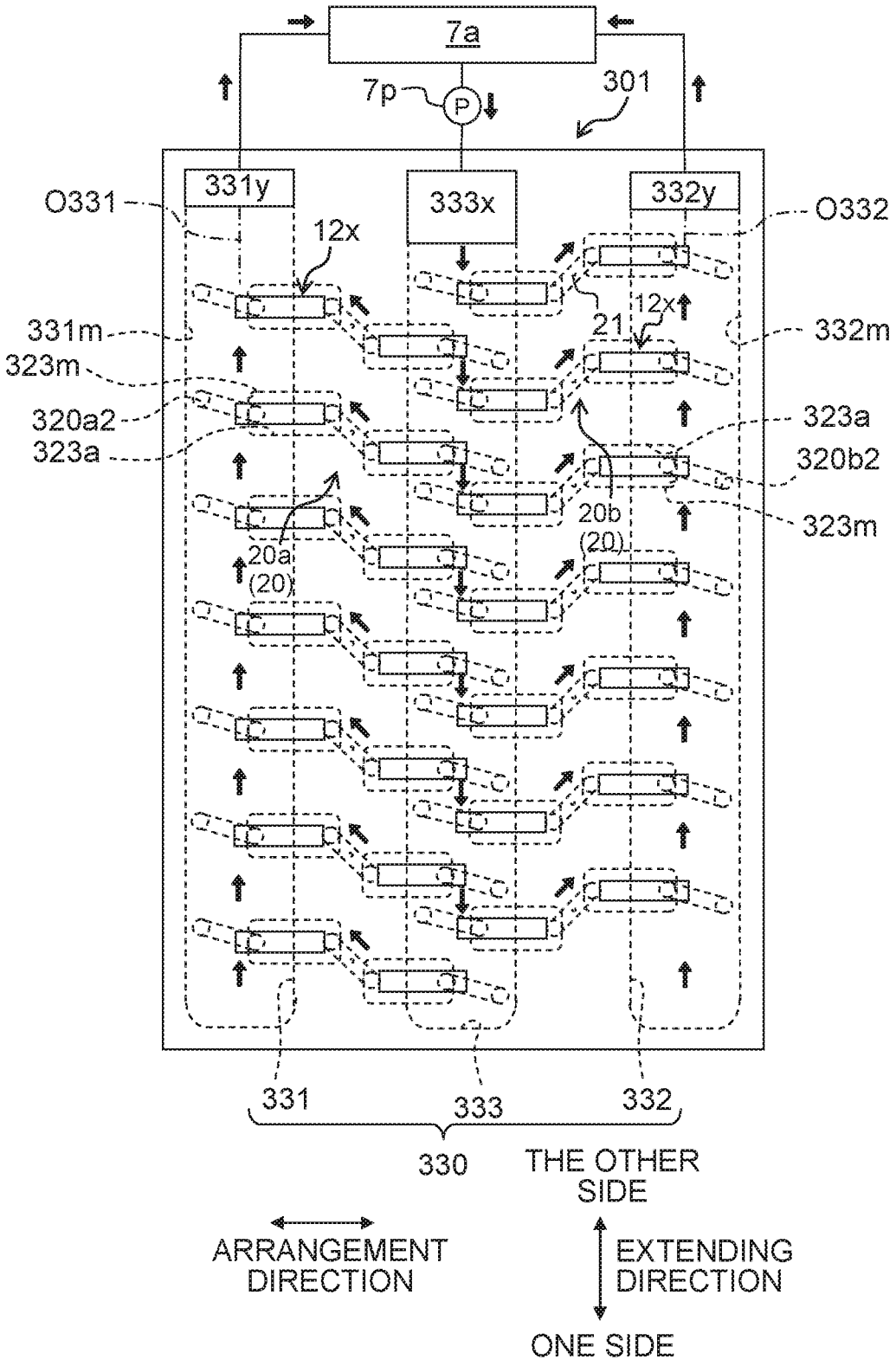
FIG. 6 is a plan view of a head 301 according to a third embodiment.

Next, a head 301 according to a third embodiment of the present disclosure will be described below by referring to FIG. 6. An arrangement of a common channel 330 differs from the arrangement of the common channel 30 in the first embodiment. Thick arrow marks in FIG. 6 show a flow of ink.

The common channel 330 includes a supply channel 333 and return channels 331 and 332 arranged in the array direction. Each of the return channels 331 and 332, and the supply channel 333, is extended in the extending direction. The supply channel 333 is arranged between the return channel 331 and the return channel 332 in the array direction.

In the present embodiment, the first individual channel 20*a* connects the return channel 331 and the supply channel 333. The second individual channel 20*b* connects the return channel 332 and the supply channel 333.

The supply channel 333 communicates with the storage chamber 7*a* via a supply port 333*x*. The return channels 331 and 332 communicate with the storage chamber 7*a* via discharge ports 331*y* and 332*y* respectively. The supply port 333*x* and the discharge ports 331*y* and 332*y* are formed at end portion in the other side of the extending direction (upward direction in FIG. 6) of the respective channels.

Ink supplied to the supply channel 333 through the supply port 333*x*, while moving inside the supply channel 333 from the other side of the extending direction toward the one side of the extending direction is supplied to each of the first individual channel 20*a* and the second individual channel 20*b*. The ink supplied to the first individual channel 20*a* flows into the return channel 331, and moves inside the return channel 331 from the one side of the extending direction toward the other side of the extending direction. Moreover, the ink is discharged from the return channel 331 via the discharge port 331*y*, and returns to the storage chamber 7*a*. The ink supplied to the second individual channel 20*b* flows into the return channel 332, and moves inside the return channel 332 from the one side of the extending direction toward the other side of the extending direction. Moreover, the ink is discharged from the return channel 332 via the discharge port 332*y*, and returns to the storage chamber 7*a*. In such manner, in the present embodiment, a direction of flow of ink in the supply channel 333 and a direction of flow of ink in the return channels 331 and 332 are mutually opposite.

In the present embodiment, the supply channel 333 corresponds to the 'supply channel', each of the return channels 331 and 332 corresponds to the 'return channel', and each of the first individual channel 20*a* and the second individual channel 20*b* corresponds to the 'individual channel'. In other words, the supply channel 333 is arranged with the return channel 331 in the array direction, sandwiching the nozzle 21 of the first individual channel 20*a*. Moreover, the supply channel 333 is arranged with the return channel 332 in the array direction, sandwiching the nozzle 21 of the second individual channel 20*b*.

According to the present embodiment, although the arrangement of the common channel 330 differs from the arrangement of the common channel 30 in the first embodiment, the rest of the arrangement being similar to the arrangement in the first embodiment, an effect similar to that of the first embodiment is achieved.

For instance, in each first individual channel 20*a*, with respect to the array direction, an end portion 323*m* at the one side in the array direction of the first pressure chamber 323*a* is positioned between the nozzle 21 and an end portion 331*m* at the one side in the array direction (leftward direction in FIG. 6) of the return channel 331. Moreover, a middle O331 in the array direction of the return channel 331 is positioned between the nozzle 21 and the outlet port 320*b*2.

Moreover, in each second individual channel 20*b*, with respect to the array direction, an end portion 323*m* at the one side in the array direction of the first pressure chamber 323*a* of the second individual channel 20*b* is positioned between the nozzle 21 and an end portion 332*m* at the one side in the array direction (rightward direction in FIG. 6) of the return channel 332. Furthermore, a middle O332 in the array direction of the return channel 332 is positioned between the nozzle 21 and the outlet port 320*b*2.

Accordingly, it is possible to let the heat of the actuator 12*x* escape efficiently when the ink is circulated, and to suppress the problem of the heat of the actuator 12*x* accumulating inside the individual channel 20.

Furthermore, according to the present embodiment, each of the return channels 331 and 332 is arranged at an end at the one side in the array direction (leftward and rightward direction in FIG. 6) of the head 301. In other words, at the one side in the array direction from each of the return channels 331 and 332, there exists no channel which is formed in the head 301. Therefore, it is possible to let the heat escape efficiently via the return channels 331 and 332 arranged at an outer edge, and to suppress assuredly the problem of the heat of the actuator 12*x* accumulating inside the individual channel 20.

Fourth Embodiment

Figure 7:
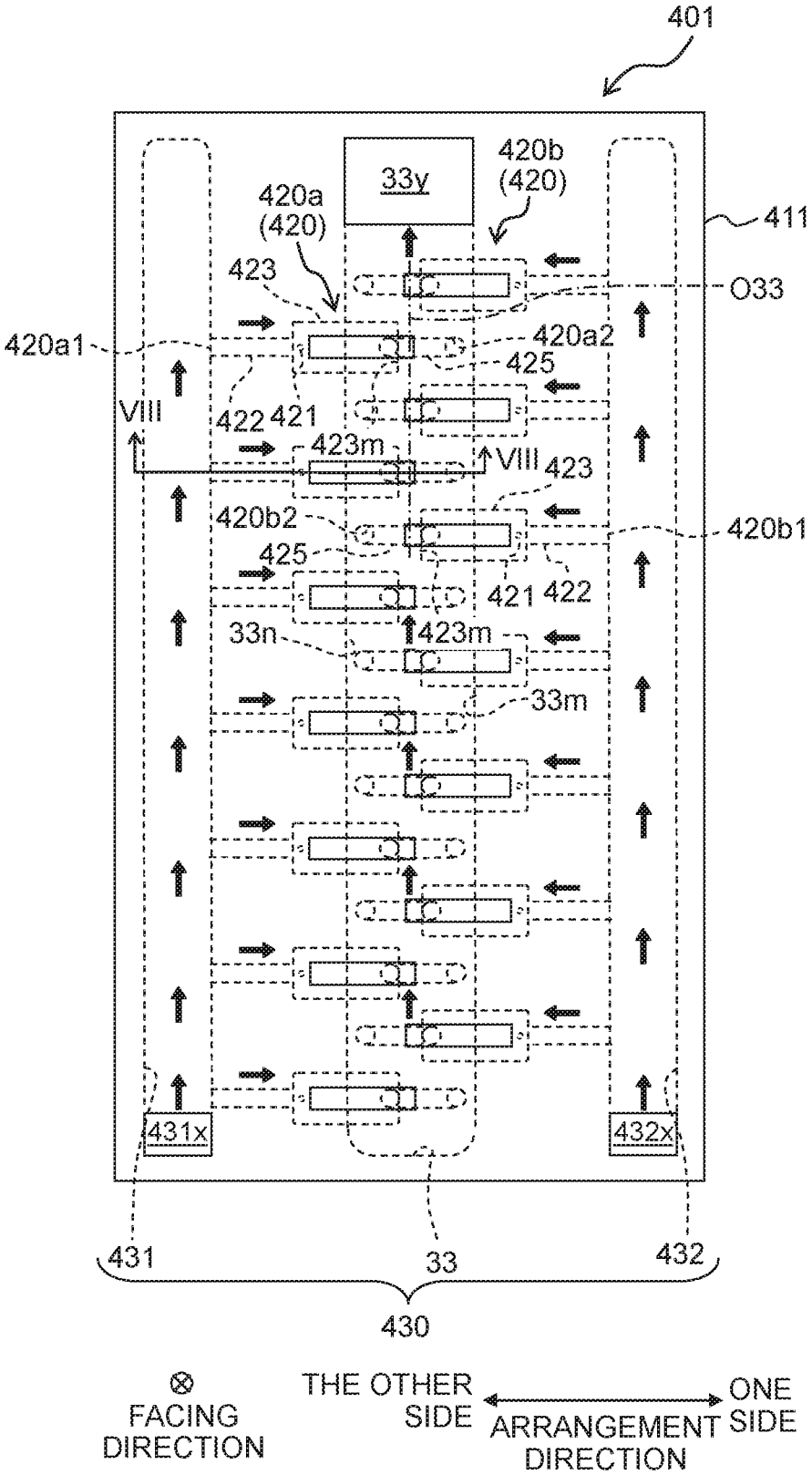
FIG. 7 is a plan view of a head 401 according to a fourth embodiment.

Next, a head 401 according to a fourth embodiment of the present disclosure will be described below by referring to FIG. 7 and FIG. 8. In the present embodiment, an arrangement of supply channels 431 and 432, and an individual channel 420 differs from an arrangement of the supply channels and the individual channel in the first embodiment. Thick arrow marks in FIG. 7 and FIG. 8 show a flow of ink.

Figure 8:
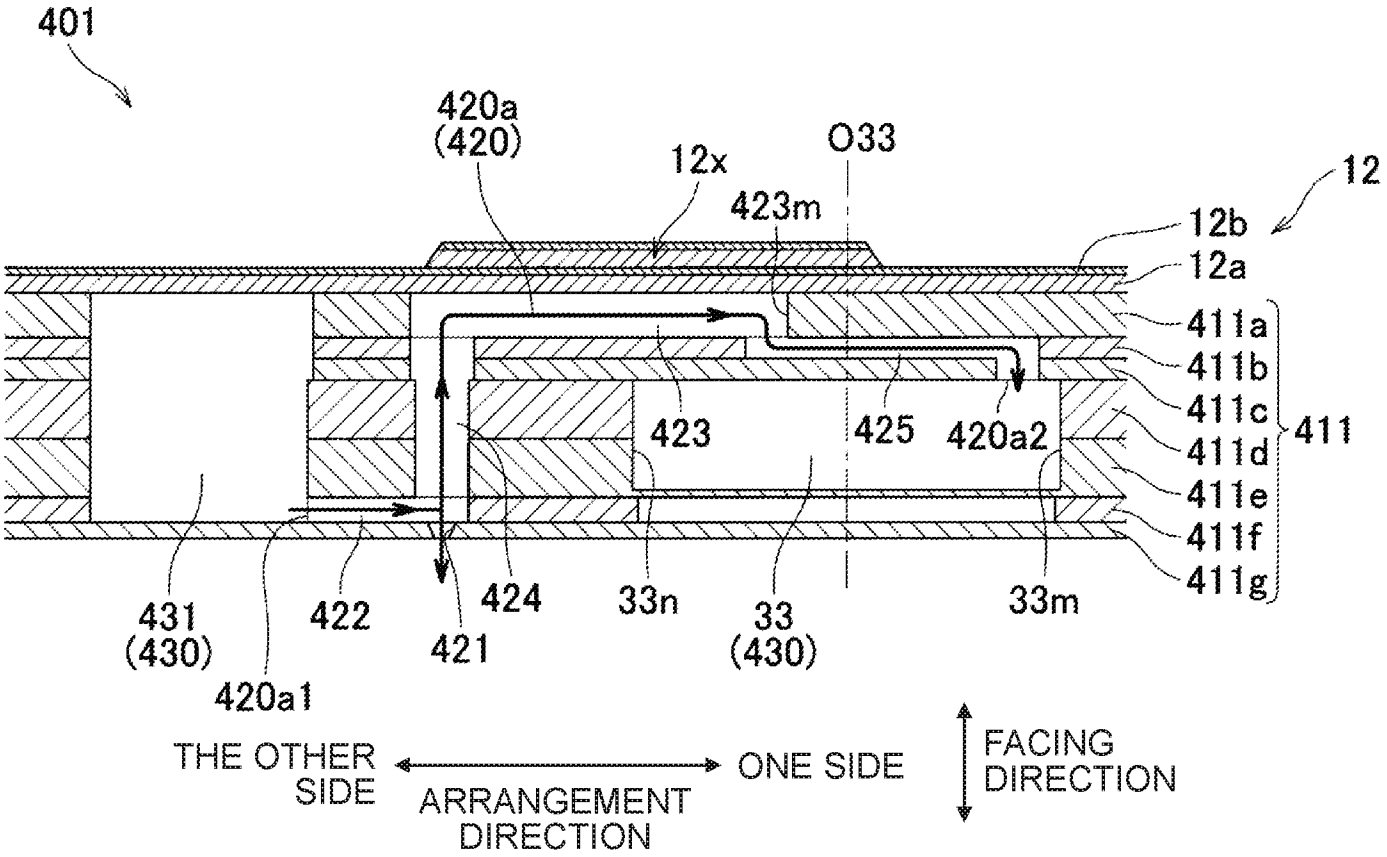
FIG. 8 is a cross-sectional view of the head 401 along a line VIII-VIII in FIG. 7.

A channel substrate 411 of the head 401, as shown in FIG. 8, includes seven plates 411*a*, 411*b*, 411*c*, 411*d*, 411*e*, 411*f*, and 411*g* (hereinafter, referred to as 'plates 411*a* to 411*g*') adhered to one another. The return channel 33 is formed in the plates 411*d* and 411*e*, and the supply channels 431 and 432 are formed in the plates 411*a* to 411*f*. A plurality of individual channels 420 which communicates with a common channel 430 (the supply channels 431 and 432, and the return channel 33) is formed in the plates 411*a* to 411*g*. A length in the facing direction of each of the supply channels 431 and 432 is nearly twice a length in the facing direction of the return channel 33. A width (length in the array direction) of each of the supply channels 431 and 432 is nearly half the width of the return channel 33.

Each individual channel 420 includes a nozzle 421, a communicating channel 422, one pressure chamber 423, a connecting channel 424, and a joining channel 425. The pressure chamber 423 communicates with the return channel 33 via the joining channel 425, and with the nozzle 421 via the connecting channel 424 and the communicating channel 422. The communicating channel 421 is a channel passing directly above the nozzle 421, and is arranged between the connecting channel 424 and the nozzle 421, and between the connecting channel 424 and the supply channel 431 or the supply channel 432. The communicating channel 422 is extended from a side of the supply channel 431 or the supply channel 432.

The supply channels 431 and 432, and the plurality of pressure chambers 423 open on an upper surface of the plate 411*a*. The vibration plate 12*a* and the common electrode 12*b* of the actuator unit 12 are arranged on nearly the entire upper surface of the plate 411*a*, and cover the supply channels 431 and 432, and the plurality of pressure chambers 423. Through holes are formed at positions of the vibration plate 12*a* and the common electrode 12*b*, corresponding to supply ports 431*x* and 432*x*, and the discharge port 33*y* (refer to FIG. 7). The supply ports 431*x* and 432*x*, and the discharge port 33*y* open on an upper surface of the head 401, and communicate with the supply ports 431 and 432, and the return channel 33 via the through holes.

The individual channel 420, as shown in FIG. 7, includes a plurality of first individual channels 420*a* connecting the supply channel 431 and the return channel 33, and a plurality of second individual channels 420*b* connecting the supply channel 432 and the return channel 33.

The first individual channel 420*a* has an inlet port 420*a*1 connecting to the supply channel 431 and an outlet port 420*a*2 connecting to the return channel 33. The inlet port 420*a*1 corresponds to an end portion on a side opposite to the pressure chamber 423, of the communicating channel 422 of the first individual channel 420*a*. The outlet port 420*a*2 corresponds to an end portion on a side opposite to the pressure chamber 423, of the joining channel 425 of the first individual channel 420*a*.

The second individual channel 420*b* has an inlet port 420*b*1 connecting to the supply channel 432 and an outlet port 420*b*2 connecting to the return channel 33. The inlet port 420*b*1 corresponds to an end portion on a side opposite to the pressure chamber 423, of the communicating channel 422 of the second individual channel 420*b*. The outlet port 420*b*2 corresponds to an end portion on a side opposite to the pressure chamber 423, of the joining channel 425 of the second individual channel 420*b*.

The communicating channel 422 and the joining channel 425, similarly as the pressure chamber 423, are extended in the array direction.

The ink supplied to each individual channel 420, as shown in FIG. 8, moves horizontally, running through the communicating channel 422 from the inlet port 420*a*1, and some of the link is jetted through the nozzle 421 and the remaining ink flows into the connecting channel 424. The ink flowed into the connecting channel 424 moves upward, running through the connecting channel 424, and flows into the pressure chamber 423. The ink moves substantially horizontally, running through the pressure chamber 423 and the joining channel 425, and flows into the return channel 33 through the outlet ports 420*a*2 and 420*b*2.

Here, in the present embodiment, the supply channel 431 corresponds to the 'supply channel', the supply channel 432 corresponds to the 'another supply channel', and the return channel 33 corresponds to the 'return channel'. The first individual channel 420*a* corresponds to the 'individual channel' and the second individual channel 420*b* corresponds to the 'another individual channel'. In other words, the supply channel 431 is arranged with the return channel 33 in the array direction, sandwiching the nozzle 421 of the first individual channel 420*a*. The supply channel 432 is arranged with the return channel 33 in the array direction, sandwiching the nozzle 421 of the second individual channel 420*b*.

According to the present embodiment, in each first individual channel 420*a*, with respect to the array direction, an end portion 423*m* at the one side in the array direction of the pressure chamber 423 of the first individual channel 420*a* is positioned between the nozzle 421 and the end portion 33*m* at the one side in the array direction of the return channel 33. Moreover, the middle (center) O33 in the array direction of the return channel is positioned between the nozzle 421 and the outlet port 420*a*2 (refer to FIG. 7 and FIG. 8). In other words, the outlet port 420*a*2 of each first individual channel 420 is a positioned farther away from the nozzle 421 than the middle (center) O33. Accordingly, it is possible let the heat of the actuator 12*x* escape efficiently when the ink is circulated, and to suppress the problem of the heat of the actuator 12*x* accumulating inside the individual channel 420.

Moreover, in each second individual channel 420*b*, with respect to the array direction, an end portion 423*n* at the other side in the array direction of the pressure chamber 423 is positioned between the nozzle 421 and the end portion 33*m* at the other side in the array direction of the return channel 33. Moreover, the middle (center) O33 in the array direction of the return channel 33 is positioned between the nozzle 421 and the outlet port 420*b*2 (refer to FIG. 7 and FIG. 8). In other words, the outlet port 420*b*2 of each second individual channel 420*b* is positioned farther away from the nozzle 421 than the middle (center) O33. Accordingly, even in a case in which the individual channels 420 are arranged highly densely, in both the first individual channel 420*a* and the second individual channel 420*b*, it is possible to let the heat of the actuator 12*x* escape efficiently when the ink is circulated, and to suppress the problem of the heat of the actuator 12*x* accumulating inside the individual channel 420. In other words, it is possible to realize both of a highly dense arrangement of the individual channels 429 and suppression of the problem of heat.

Moreover, according to the present embodiment, by providing an arrangement similar to that of the first embodiment, an effect similar to that of the first embodiment is achieved.

Modified Embodiments

The preferred embodiments of the present disclosure have been described heretofore. However, the present disclosure is not restricted to the embodiments described above, and various design modifications are possible within the scope of the patent claim.

In the first embodiment, in the two joining channels 25 of the first individual channel 20*a* and the two joining channels 25 in the second individual channel 20*b*, the angle θ25 on the acute angle side with respect to the array direction is mutually same. However, the angle θ25 may differ mutually. Moreover, in the communicating channel 22 of the first individual channel 20*a* and the communicating channel 22 of the second individual channel 20*b*, the angle θ22 on the acute angle side with respect to the array direction is mutually same. However, the angle θ22 may differ mutually.

The number of common channels is three in the abovementioned embodiments. However, the number of common channels may be two or not less than four. In a case in which the number of common channels is two, one supply channel and one return channel are provided, and an embodiment is without the 'another supply channel' and the 'another individual channel'. Moreover, one end in the extending direction of the supply channel and one end in the extending direction of the return channel may have been connected.

A size and a position of the supply port and the discharge port are not restricted in particular. For instance, in the abovementioned embodiments, the area of the discharge port or the supply port arranged at the middle (center) in the array direction is larger than the area of the supply port or the discharge port arranged at two ends in the array direction. However, the two areas may be mutually same.

The number of nozzles in the individual channel is one in the abovementioned embodiments. However, the number of nozzles in the individual channel may be two or more than two.

The number of pressure chambers in the individual channel may be three or more than three.

The actuator is not restricted to an actuator of a piezo type in which a piezoelectric element is used, and may be an actuator of other type (such as a thermal type in which a heating element is used and an electrostatic type in which an electrostatic force is used).

The head is not restricted to be of a line type, and may be of a serial type (a type in which a liquid is jetted from nozzles on to an object of jetting while moving in a scanning direction which is parallel to the paper-width direction).

The object of jetting is not restricted to paper, and may be an object such as a cloth and a substrate.

The liquid to be jetted from the nozzle is not restricted to ink, and may be an arbitrary liquid (such as a process (treatment) liquid which agglutinates or precipitates constituents of ink).

The present disclosure is not restricted to printers, and is also applicable to a facsimile, a copy machine, and a multifunction device. Moreover, the present disclosure is also applicable to a liquid discharge apparatus which is used for an application other than recording of image (such as a liquid discharge apparatus which forms an electroconductive pattern by jetting an electroconductive liquid on to a substrate).

What is claimed is:

1. A liquid discharge head, comprising:

a plurality of individual channels each including a nozzle and a pressure chamber communicating with the nozzle;

an actuator facing the pressure chamber in a facing direction;

a supply channel communicating with a storage chamber configured to store a liquid and an inlet port of the plurality of individual channels, the supply channel being configured to supply the liquid from the storage chamber to the plurality of individual channels, and extending in an extending direction orthogonal to the facing direction; and a return channel communicating with an outlet port of the plurality of individual channels and the storage chamber, the return channel being configured to return the liquid from the plurality of individual channels to the storage chamber, and extending in the extending direction and arranged along with the supply channel in an array direction which is orthogonal to the extending direction and the facing direction, wherein for each of the plurality of individual channels:

the return channel and the pressure chamber are arranged at one side of the nozzle in the array direction, and the supply channel is arranged at the other side of the nozzle in the array direction, an end portion of the pressure chamber at the one side in the array direction is positioned between the nozzle and an end portion of the return channel at the one side in the array direction, and a center of the return channel in the array direction is positioned between the nozzle and the outlet port.

2. The liquid discharge head according to claim 1, wherein the outlet port is located at a position not overlapping with the actuator in the facing direction.

3. The liquid discharge head according to claim 1, wherein the return channel includes: the outlet port located at one side in the facing direction; and a damper chamber located at the other side in the facing direction, the one side in the facing direction being a direction directed from the pressure chamber toward the actuator, and wherein the outlet port is located at a position overlapping with the damper chamber in the facing direction.

4. The liquid discharge head according to claim 1, wherein each of the plurality of individual channels includes a joining channel including the outlet port and joining the pressure chamber and the return channel, and wherein the joining channel is extended in a direction intersecting the array direction.

5. The liquid discharge head according to claim 1, further comprising:

a plurality of other individual channels, each including another nozzle and another pressure chamber communicating with the another nozzle;

another actuator facing the another pressure chamber in the facing direction; and another supply channel communicating with the storage chamber and an inlet port of the plurality of other individual channels, and being configured to supply a liquid from the storage chamber to the plurality of other individual channels, extended in the extending direction, and arranged along with the return channel in the array direction while sandwiching the another nozzle, wherein the return channel communicates with an outlet port of the plurality of other individual channels, and wherein for each of the plurality of other individual channels:

the return channel and the another pressure chamber are arranged at the other side of the another nozzle in the array direction, and the another supply channel is arranged at the one side of the another nozzle in the array direction, an end portion of the another pressure chamber at the other side in the array direction is positioned between the another nozzle and an end portion of the return channel at the other side in the array direction, and the center of the return channel in the array direction is positioned between the another nozzle and the outlet port.

6. The liquid discharge head according to claim 1, wherein each of the plurality of individual channels includes: a first pressure chamber corresponding to the pressure chamber; and a second pressure chamber communicating with the nozzle, the second pressure chamber being arranged at the other side of the nozzle in the array direction, wherein the liquid discharge head further comprises:

a first actuator which is the actuator; and a second actuator facing the second pressure chamber in the facing direction, and wherein for each of the plurality of individual channels:

an end portion, of the second pressure chamber, at the other side in the array direction is positioned between the nozzle and the end portion, of the supply channel, at the other side in the array direction, and a center of the supply channel in the array direction is positioned between the nozzle and the inlet port.

7. The liquid discharge head according to claim 6, wherein for each individual channel of the plurality of individual channels:

the outlet port is located at a position not overlapping with the first actuator in the facing direction, and the inlet port is located at a position not overlapping with the second actuator in the facing direction.

8. The liquid discharge head according to claim 6, wherein each of the return channel and the supply channel includes: the outlet port and the inlet port which are provided at one side in a facing direction; and a damper chamber which is provided at the other side in the facing direction, the facing direction being a direction directing from the first and second pressure chambers toward the first and second actuators, respectively, and wherein each of the outlet port and the inlet port is located at a position overlapping with the damper chamber in the facing direction.

9. The liquid discharge head according to claim 6, wherein for each of the plurality of individual channels:

a distance separating the inlet port and the center of the supply channel in the array direction is larger than or equal to a length of the supply channel in the facing direction.

10. The liquid discharge head according to claim 6, wherein each of the plurality of individual channels includes: a first joining channel including the outlet port and joining the first pressure chamber and the return channel; and a second joining channel including the inlet port and joining the second pressure chamber and the supply channel, and wherein each of the first joining channel and the second joining channel is extended in a direction intersecting the array direction.

11. The liquid discharge head according to claim 6, further comprising:

a plurality of other individual channels, each including another nozzle and another pressure chamber communicating with the another nozzle;

another actuator facing the another pressure chamber in the facing direction; and another supply channel communicating with the storage chamber and an inlet port of the plurality of other individual channels, the another supply channel being configured to supply a liquid from the storage chamber to the plurality of other individual channels, extended in the extending direction, and arranged along with the return channel in the array direction while sandwiching the another nozzle, wherein the return channel communicates with an outlet port of the plurality of other individual channels, wherein for each of the plurality of other individual channels:

the return channel and the another pressure chamber are arranged at the other side of the another nozzle in the array direction, an end portion of the another pressure chamber at the other side in the array direction is positioned between the another nozzle and an end portion of the return channel at the other side in the array direction, and the center of the return channel in the array direction is positioned between the another nozzle and the outlet port, wherein each of the plurality of individual channels includes: another first pressure chamber corresponding to the another pressure chamber; and another second pressure chamber communicating with the another nozzle, the another second pressure chamber being arranged at the one side of the another nozzle in the array direction, wherein the liquid discharge head further comprising:

another first actuator corresponding to the another actuator; and another second actuator facing the another second pressure chamber in the facing direction, and wherein for each of the plurality of other individual channels:

an end portion, of the another second pressure chamber, at the one side in the array direction is positioned between the another nozzle and an end portion, of the another supply channel, at the one side in the array direction, and a center of the another supply channel in the array direction is positioned between the another nozzle and the another inlet port.

12. The liquid discharge head according to claim 11, wherein each of the plurality of individual channels includes: a communicating channel passing above the nozzle; and a first joining channel including the outlet port and joining the first pressure chamber and the return channel, wherein each of the plurality of another individual channels includes: another communicating channel passing above the another nozzle; and another first joining channel including the outlet port and joining the another first pressure chamber and the return channel, wherein the communicating channel, the first joining channel, the another communicating channel, and the another first joining channel are extended in a direction intersecting the array direction, and wherein each of an acute angle of the first joining channel with respect to the array direction and an acute angle of the another first joining channel with respect to the array direction is smaller than an acute angle of the communicating channel with respect to the array direction, and is smaller than an acute angle of the another communicating channel with respect to the array direction.

13. The liquid discharge head according to claim 1, wherein the outlet port of the plurality of individual channels and the outlet port of the plurality of other individual channels are arranged in a staggered form alternately in the extending direction.

14. The liquid discharge head according to claim 5, wherein the outlet port of the plurality of individual channels is located at a position overlapping with the another actuator in the facing direction, and wherein the outlet port of the plurality of other individual channels is located at a position overlapping with the actuator in the facing direction.

15. The liquid discharge head according to claim 5, wherein each of the supply channel and the another supply channel has a resistance higher than a resistance of the return channel.

16. The liquid discharge head according to claim 15, wherein each of the supply channel and the another supply channel has a cross-sectional area smaller than a cross-sectional area of the return channel.

17. The liquid discharge head according to claim 16, wherein each of the supply channel and the another supply channel has a length in the facing direction smaller than a length of the return channel in the facing direction.

18. The liquid discharge head according to claim 16, wherein each of the supply channel and the another supply channel has a length in the array direction smaller than a length of the return channel in the array direction.

19. The liquid discharge head according to claim 1, wherein the return channel is arranged at one end of the liquid discharge head in the array direction.

20. The liquid discharge head according to claim 1, wherein each of the plurality of individual channels includes a communicating channel passing above the nozzle, and the communicating channel is extended in a direction intersecting the array direction.

21. The liquid discharge head according to claim 1, wherein the liquid discharge head is of a line type in which the liquid is discharged through the nozzle onto an object, in a state of a position of the liquid discharge head being fixed.

* * * * *